US005117570A

United States Patent [19]

Morosini

[11] Patent Number: 5,117,570

[45] Date of Patent: Jun. 2, 1992

[54] DEVICE FOR PICK-UP AND ASSEMBLY OF ELEMENTS OF IDENTIFICATION OF CABLES AND ELECTRICAL APPLICANCES

[76] Inventor: Flavio Morosini, 18, rue du Rouvion, F-54800 Hatrize, France

[21] Appl. No.: 551,952

[22] Filed: Jul. 12, 1990

Related U.S. Application Data

[63] Continuation-in-part of Ser. No. 485,214, Feb. 26, 1990, Pat. No. 5,078,829, which is a continuation-in-part of Ser. No. 218,288, Jun. 13, 1988, Pat. No. 4,904,335.

[30] Foreign Application Priority Data

Aug. 14, 1986 [FR] France ..... 86 11768
Jul. 31, 1987 [IT] Italy ..... 43519 A/87

[51] Int. Cl.[5] ..... G09F 3/00
[52] U.S. Cl. ..... 40/316; 40/665
[58] Field of Search ..... 40/316, 305, 299, 665, 40/664, 645, 640, 5, 660; 174/112

[56] References Cited

U.S. PATENT DOCUMENTS 80,967 8/1868 Jones ..... 40/305
936,918 10/1909 Long et al. ..... 40/305
1,563,371 12/1925 Jones ..... 40/316
3,474,559 10/1969 Hunt ..... 40/316
4,539,767 9/1985 Jaffe ..... 40/316

FOREIGN PATENT DOCUMENTS 364539 11/1962 Switzerland ..... 174/112
452017 5/1968 Switzerland ..... 40/316

*Primary Examiner*—Kenneth J. Dorner
*Assistant Examiner*—Brian K. Green
*Attorney, Agent, or Firm*—Horst M. Kasper

[57] ABSTRACT

A support and fixation device supporting a marker carrier (101) comprises a tubular cover (101*a*) and a tubular housing (101*b*). The tubular housing is furnished with a retaining section running substantially parallel to lengthwise direction of the tube for receiving and retaining pointers. A flat band section (103), made of a flexible material, is furnished at each of its ends with an opening (104). The flat band section is received in the tubular cover and the tubular cover is disposed between the openings. At least one of the openings is crossed over by a flexible, longitudinal crossing-over bridge (105).

16 Claims, 10 Drawing Sheets

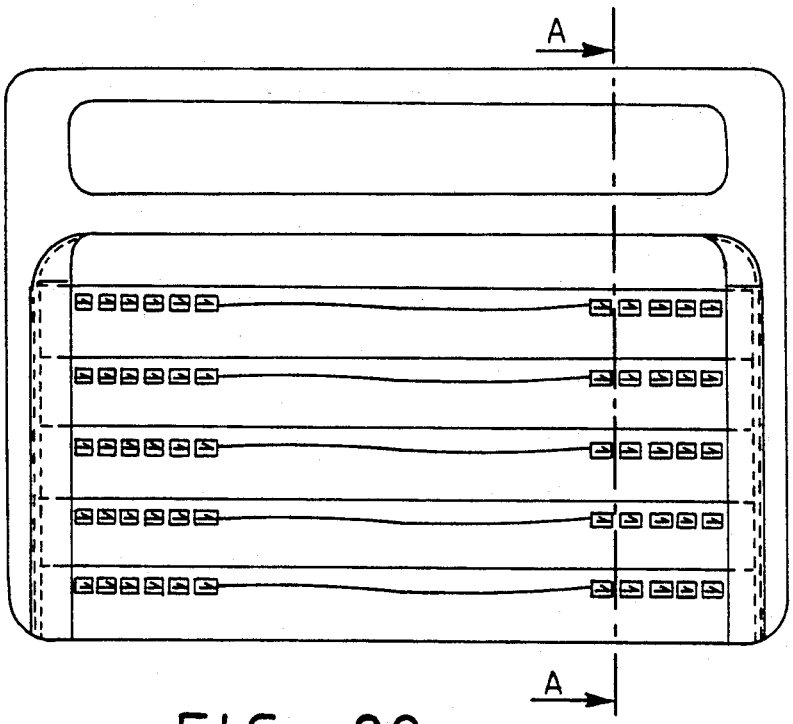
FIG. 20
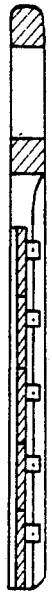
FIG. 21
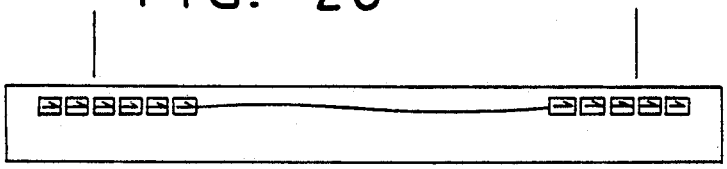
FIG. 22
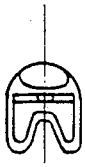
FIG. 23
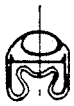
FIG. 24
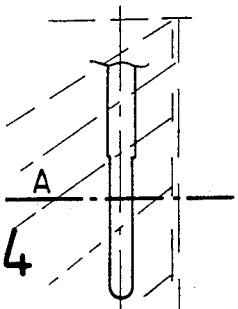
FIG. 26
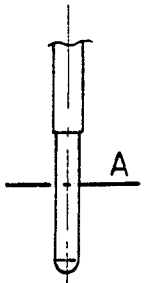
FIG. 30
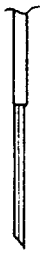
FIG. 34
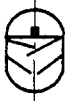
FIG. 25
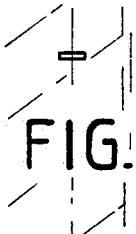
FIG. 27
FIG. 31
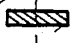
FIG. 28
FIG. 32
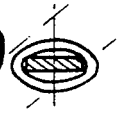
FIG. 29
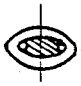
FIG. 33

208
206
210
209
220
214
204
205
203
202
211
212
213
201
207

DEVICE FOR PICK-UP AND ASSEMBLY OF ELEMENTS OF IDENTIFICATION OF CABLES AND ELECTRICAL APPLICANCES

CROSS-REFERENCE TO RELATED APPLICATIONS

This application is a continuation-in-part application of another application filed Feb. 26, 1990 and bearing Ser. No. 07/485,214, now U.S. Pat. No. 5,078,829, which in turn is a continuation-in-part application of an application filed Jun. 13, 1988 and bearing Ser. No. 218,288, now U.S. Pat. No. 4,904,335. The entire disclosure of these latter applications, including the drawings thereof, is hereby incorporated in this application as if fully set forth herein.

BACKGROUND OF THE INVENTION

1. Field of the Invention

The invention has as its object a device which greatly facilitates the pick-up and assembly, in accordance with a well-defined code, of elements of identification which are currently in use for locating the wire strands at two distant ends of an electric cable, or the terminals of electrical appliances.

2. Brief Description of the Background of the Invention Including Prior Art

There are in existence elements of identification of various types; the invention is in no way limited to a specific type of elements of identification; it is possible to readily adapt it to different types of elements. To be more explicit, we shall in the following refer to elements of identification which, either totally or in part, consist of a link or a sleeve or at least of a ring-shaped configuration, into which can be introduced a rod which enables the pick-up of one specific element from the entire assembly of elements.

An example of elements of identification of this type with which the device of the invention can be used is disclosed in French Patent FR-A 2,239,182. In this document, tubular elements of identification are described which bear a symbol, either a number or a letter, and which are arranged in order in the switch cabinet in rows of several elements, whereby each row bears identical symbols. A short measuring tape is designed to be successively threaded into several ring-shaped elements which are picked up, one by one, in the desired order, to compose a message code of identification, for example, a number. The elements which compose this message are then transferred, as a whole, on a carrier for the message code of identification already fixed or destined to be fixed on a wire strand of a cable or on an electric terminal. Hence, each message to identification is composed individually, element by element.

Known means of identification include the following:

a carrier with distinct rows for the elements of identification, the elements of identification, at least partially tubular, are arranged in order on these rows and are spaced by a defined first step P1 and bear in each row an identical symbol, the carriers are constructed to each receive a series of elements of identification, thus composing a message code of identification, a means for picking-up these elements of identification which has a section which can be threaded into a tubular part of the elements of identification.

The device of the invention comprises a comb with parallel teeth which are spaced by a second step P2, the value of which is equal to or several times the value of a first step P1 of the elements of identification of a combined comb. Each of these teeth is designed to have mounted, in a removable manner, a carrier of a series of elements which compose a message code of identification. A means of pick-up includes at least two parallel arms which are spaced at a step P2 which is identical to the step P2 of the teeth of the comb. Each of these arms has a very straight part which can be threaded into the tubular section of the elements of identification. This straight part is limited, opposite to its free end, by a stop catch.

According to an improvement and further development of the invention, the comb comprises or consists of two halves which can be easily assembled or separated and of a joint face, where the thickness of said halves permits the interface to be fitted between the two halves. The successively arranged teeth of the comb belong, alternately, either to the one or the other half. Preferably, the teeth of at least one of these halves are off-set so that all teeth are on the same face once the two halves are assembled.

In order to mark electrical cables, either individually or in bundles, it is known to form markers which are furnished as a combination of an alphanumerical pointer which is preassembled on a marker-support carrier.

These alphanumerical pointers are generally formed from flexible tubular sections which carry a number or a letter and which are introduced into a housing for the marker-support carrier. For this purpose, the marker-support carrier, according to the present invention, is formed of a tubular cover section carrying in the longitudinal direction of one of its generators of the said housing which is also formed by a tube arranged in the wall of the cover. The conductor to be marked can be thus introduced into the tubular cover which closes it more or less elastically.

In certain cases, the cables to be marked have a diameter which is too large in order to be introduced into the tubular marker carrier. In other cases, one has to mark an assembly of conductors which are combined into a bundle.

The invention furnishes a device for support and for fixing of these marker carriers in order to allow them to be put in position on any type of conductor regardless of its diameter.

For this purpose, the invention discloses a support and fixation device for a marker carrier formed as a tubular cover, where several pointers are placed and assembled in a housing of said cover, where the support and fixation device is formed by a band section of a flexible material, where the band section is furnished at each one of its ends with an opening, where at least one of the ends is covered by a flexible longitudinal crossing-over.

The second opening can equally have a flexible crossing-over.

Each crossing-over is advantageously divisible at the level of one or of its two feet, and forms, in case of a cut of its foot on the side of the middle part of the section, a retainer hook for the tubular marker carrier.

The said band section is preferably formed by a detachable part of one band, where at least one of the ends is extended by small tapered tongue for the introduction of the marker carriers.

The present invention also relates to a device for maintaining and presenting platelets of pointer supports in a position facilitating their getting apart by means of a gripper which is generally known and which is formed by a stem which one introduces into the pointer.

Such pointer tubes are known and serve in particular for the marking of electrical conductors and they are associated for forming a number or an alphanumeric combination which is placed in an marking carrier. On the one hand, this assures the cohesion and the permanent support of the combination thus formed and, on the other hand, comprises as means for fixing the marking to the wire or to the cable to be identified.

The pointers are in most of the cases glued onto the support leaves or onto the platelets, along a line, and each support is furnished with a plurality of the same pointers. The composition of the marker comprises therefore to set apart each of the pointers which form it on the different supports. In order to facilitate this setting apart, the supports are placed in the compartments of storage frame in such a way that all the pointers are visible and individually accesible. In the structures known, one of the inconveniences is associated with the fact that the gripper exerts a rubbing force onto the pointer which is rapidly stronger than the adherence force which retains the pointer on its support and which provokes the detachment of the pointer before it is well joined by the stem of the gripper. It can thus spontaneously detach itself and fall on the bottom of the storage frame or onto the floor. It is a difficult and costly operation to recover the pointer and it would represent a loss not to recover.

In order to obviate this inconvenience, the invention discloses a storage frame where the pointers are safely retained until the gripper is completely introduced, which avoids a loss of time or a loss of pointers.

It is an object of the invention to provide for a storage frame for maintaining and for presenting of a plurality of the support platelets for tubular pointers, glued in line on each of the platelets. The storage frame comprises a plurality of inclined compartments into each one of which compartments a platelet is disposed. Each compartment of the storage frame is delimited by a pair of partitions, which are spaced apart from each other by a distance smaller than the thickness (diameter) of the tubular pointer, whereas the space between each pair of partitions has a depth which is at least equal to the axial length of each one of the pointers.

According to a first embodiment, each pair of partitions is formed by the branches of a U profile, where its ends are interdependent of the side walls of the storage frame. The height of the side walls defines the depth of the space between the compartments.

According to a second embodiment, each pair of partitions comprises a main support partition for the rear face of each platelet, and a front partition comprising a lower part spaced from the main partition by a distance greater than the thickness of the platelet furnished with its pointers, and one upper part turned toward the main partition in order to take up a rest support on the front face of each platelet above the pointer row.

The lower part of the front partition can advantageously be formed by a rear partition of the adjacent pair.

Moreover, the upper part of the partition can be of a height which is at least equal to the axial length of the pointers and which exhibits, in its near zone of its connection with the lower part, an inclined part over the width of the lower part of the compartment which forms the cam surface for the end of a gripper, known in principle.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 20 is a view of a sequence of magazine frames, FIG. 21 illustrates the section through the magazine frames of FIG. 20, FIG. 22 is a side elevational vies of an element of FIG. 20, FIG. 23 is a sectional view of a carrier according to the invention, FIG. 24 is a sectional view of another embodiment of a carrier according to the invention, FIG. 25 is a sectional view of a further embodiment of a carrier according to the invention, FIG. 26 is a top view of a finger, FIG. 27 is a cross-sectional view of the finger at the level A of FIG. 26, FIG. 28 is a cross-sectional view at a wider collar of the embodiment of FIG. 26, FIG. 29 shows the placement of a profile onto a finger as illustrated in FIG. 26, FIG. 30 is a top view of a finger, FIG. 31 is a cross-sectional view of the finger of FIG. 30, FIG. 32 is a cross-sectional view of a wider embodiment of the finger of FIG. 30, FIG. 33 illustrates the placement of a tubular part onto the finger of FIG. 30, FIG. 34 is a cross-sectional view of the embodiments according to FIG. 30 and/or FIG. 26.

DESCRIPTION OF INVENTION AND PREFERRED EMBODIMENT

Figure 1:
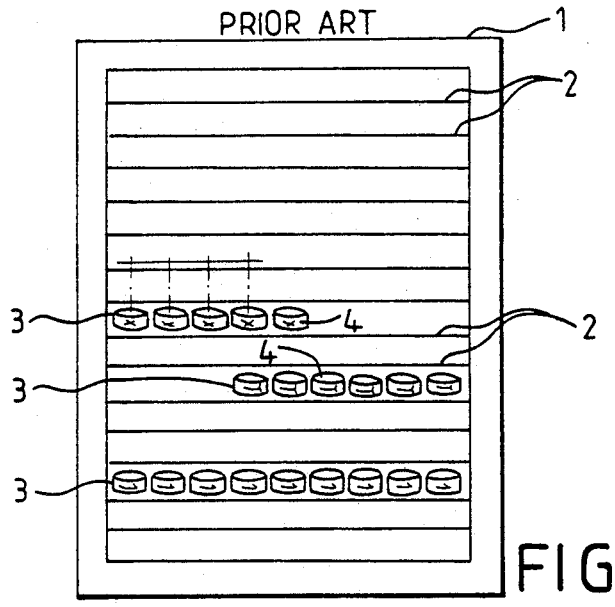
FIG. 1 is a top view of a conventional carrier with distinct rows carrying the conventional elements of identification.

FIG. 1 shows a switch cover 1, where the inside of the switch cover 1 is divided by inclined parallel partitions 2. Successive rows 3 of tubular elements of identification 4 are arranged on the partitions 2. These tubular elements are formed by the end pieces of plastic tubes, with an out-of-round cross-section. On the outer face of each of the elements 4 is imprinted an identification symbol, for example an X, or a T, or a 1, or any other sign. On an identical row 3, all elements of identification 4 bear the same symbol. On each row, the elements 4 are spaced at a defined step P1. The elements 4 are fastened on the inclined partitions 2 by means of an adhesive material which permits their removal with a minimum of force. Such an assembly is well known and commercially available.

Figure 2:
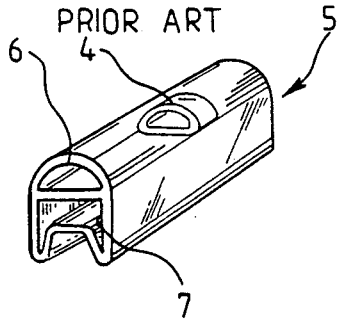
FIG. 2 presents a perspective view of a known carrier for elements of identification composing a message code of identification.

FIG. 2 shows a conventional carrier 5 which is designed to receive several elements of identification 4 which are arranged in order for composing an identification message. This carrier 5 consists of an assembly of end pieces of double tubes of a transparent and flexible plastic material. The carrier 5 exhibits a first tubular section 6 and a second tubular section 7. The latter serves to join the carrier 5 to a wire strand or to a cable to be identified, i.e. the strand or the cable can be threaded through this second tubular section 7. The first tubular section 6 has an inner cross-section which is analogous to and matches the outer cross-section of the elements of identification 4e. This permits the threading of the latter with a minimum of force and holding the threaded elements 4 in place by the natural elasticity of the material. Only one such identification element 4 is illustrated in FIG. 2.

Figure 3:
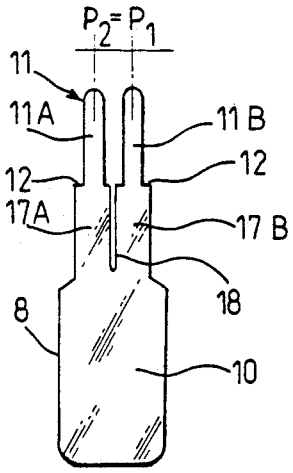
FIG. 3 is a top view onto a first embodiment of a pick-up in accordance with the invention.
Figure 4:
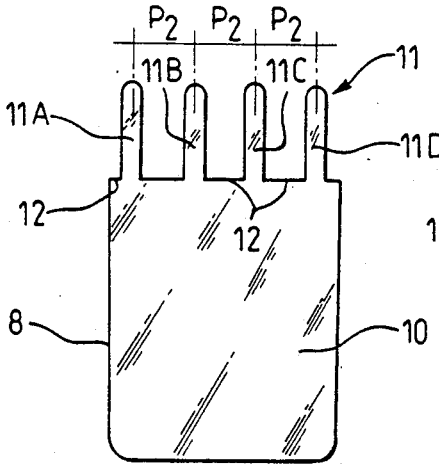
FIG. 4 is a top view onto a second embodiment of a pick-up in accordance with the invention.
Figure 6:
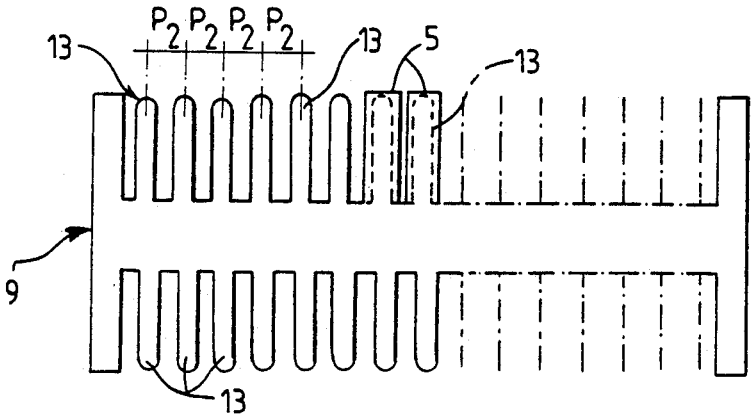
FIG. 6 presents a top view onto a comb in accordance with the invention which can be used with the pick-up according to FIG. 3.

FIGS. 3 and 4 show a pick-up 8 according to the invention which can be used with the comb 9 of the invention, depicted in FIG. 6. The pick-up 8 has a flat body 10 so that it can be held easily with the fingers of a hand. One of the ends of the pick-up 8 is equipped with several parallel arms 11. The pick-up 8 of FIG. 3 is equipped with two arms 11A and 11B and the pick-up of FIG. 4 with four arms, 11A to 11D. This number is only limited by the preferred way of using the pick-up. The parallel arms 11A to 11B are spaced by a step P2, the value of which is equal to the value of step P1 of the elements of identification 4 in the switch cover 1. Each arm 11 is delimited opposite to its free end, but preferably on two opposing ends, by a collar 12. These collars 12 determine the length of the arms 11, their length being equal to the length of the carrier 5. These collars 12 serve to arrest the elements of identification 4 which are threaded on the arms 11.

Figure 5:
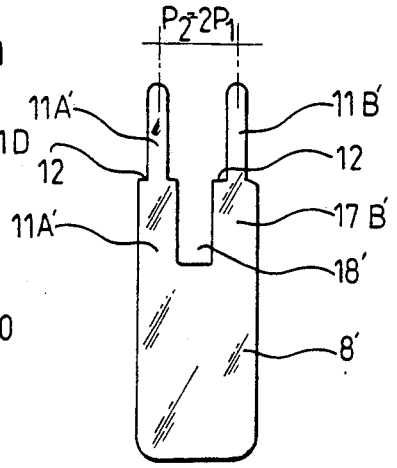
FIG. 5 is a top view onto a third embodiment of a pick-up in accordance with the invention.
Figure 7:
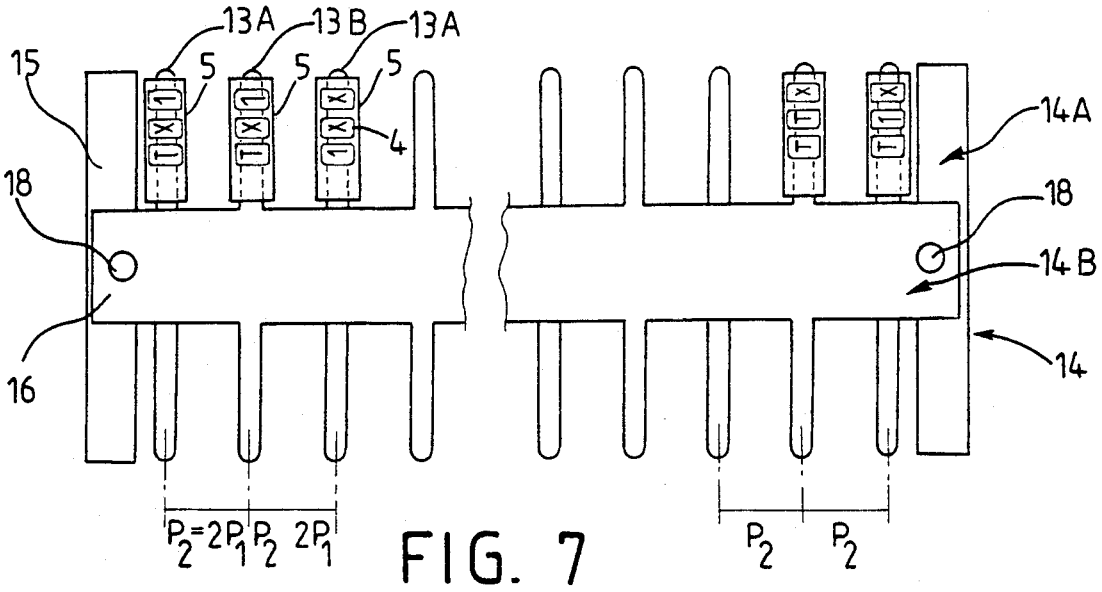
FIG. 7 presents a top view onto a comb in accordance with the invention which can be used with the pick-up according to FIG. 5 and which can be separated into two halves.

The comb 9 is equipped with teeth 13 on two opposite sides. These teeth 13 are parallel and spaced by a step P2 which is equal to that of the arms 11. The cross-section and the length of the teeth 13 are chosen for their capability of a thread or attach a carrier 5 of FIG. 2 by introducing a tooth 13 into the second tubular section 7 of the carrier. Each carrier 5 threaded onto a tooth 13 is retained in place by friction and can easily be removed with a minimum of force. FIG. 5 only shows two carriers 5 threaded onto two teeth 13. In this state, the first tubular section 6 of all carriers 5 is on the same side of comb 9. It is thus easy to simultaneously pick up several elements of identification 4 in the switch cover 1 with the pick-up means 8, by introducing the arms 11 of the latter into several elements of identification 4 which are successively arranged at spaces of a step distance P1 which is equal to the step P2 of the arms 11. Then, having picked up several identification elements 4, they can be introduced simultaneously into the first tubular section 6 which has an equal number of carriers 5 which are supported on the teeth 13 of the comb 9. During this operation, each element 4 can slide along the arm 11 with which it has been picked up but is finally stopped by the collar 12 against which an innermost identification element comes to rest. It can then be forced to a desired depth inside the first tubular section 6. FIG. 7 shows elements 4 successively threaded in the carriers 5 at different depths in order to compose a message code of identification, for example TX1 or TTX, simultaneously in several carriers 5.

In this way it is possible to prepare on one or several combs 9, a large number of carriers 5 which each carry the same message code of identification as a function of the number of arms 11 of the pick-up 8. This number is only limited by the way in which one wishes to use the pick-up.

FIG. 5 shows a pick-up 8 which is identical to that of FIG. 3 and consists of two arms 11A and 11B, with the difference, however, that the arms 11A' and 11B' are spaced at a second interval spacing P2 which is diuble the step P1.

Under certain circumstances, the carriers 5 may be of a size which makes it difficult or even impossible to thread them on successive teeth 13 of the comb 9, separated by a step distance P2=P1. In such a case, step distance P2 of the teeth 13 is given a value which is an integral multiple of P1. Naturally, this value is also given to the interval which separates the axes of the arms 11. In the switch cover 1, the elements of identification 4 remain at the distance of the value P1. During pick-up, the elements 4 are thus not next to, but separate from step P2. FIG. 7 shows a comb 14 with teeth 13 separated by a step distance P2=2P1 which can be used with the pick-up means 8' of FIG. 5.

Figure 8:
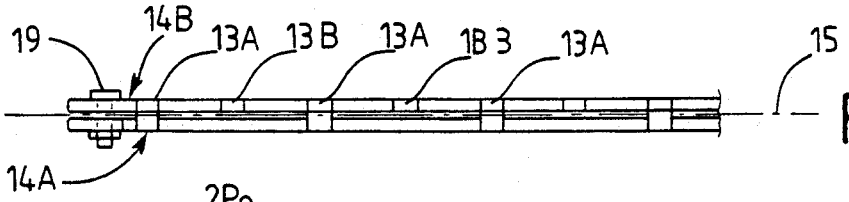
FIG. 8 presents a front view of the comb according to FIG. 7.
Figure 9:
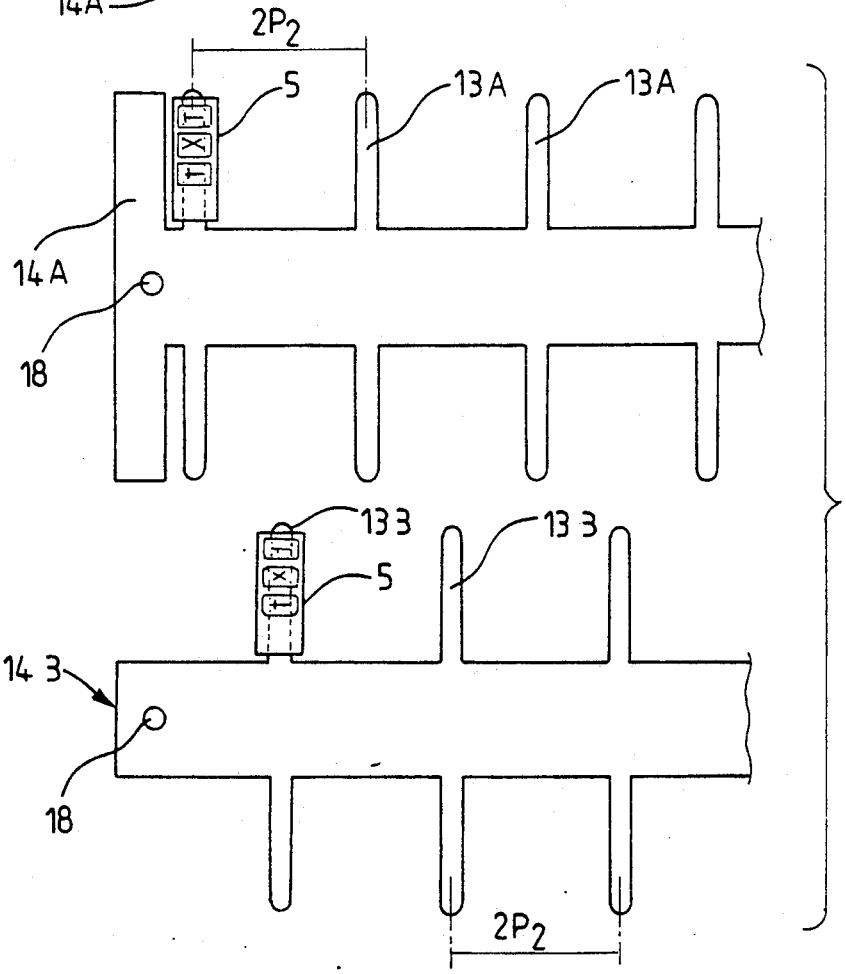
FIG. 9 presents a view of the comb according to FIG. 7, separated into two halves.

According to a further development and improvement of the invention, the comb 14 of FIG. 7 has an additional feature. It consists of two halves 14A and 14B which are assembled but can be separated by a joint face 15 of suitable thickness, as shown in FIGS. 8 and 9. The joint face 15 being depicted in FIG. 8 by a dot-and-dash line. The word "half" does not mean that the comb 14 is strictly separated into two identical parts. It means that one half of the teeth, possibly minus one unit, belongs to a first small plate 15 and that the second half of this number of teeth, possibly plus one unit, belong to a second small plate 16 so that on assembling and attaching to one another the two small plates, successive teeth belong, alternatively, to the first small plate 15 and to the second small plate 16.

We distinguish, therefore, between the teeth 13A of the second comb 14A and the teeth 13B of the first comb 14B. The two small plates 15, 16, provided with teeth, are assembled by any possible means which permit their joining and separating in an easy and rapid manner. Assembled appropriately, they are ready for use. FIGS. 7 and 8 show that, for such an assembly, holes 18 and screws 19 are provided.

It is preferable to have all teeth 13A and 13B on the same face once the two halves 14A and 14B have been assembled. FIG. 8 shows that the teeth 13A of the small plate 14A have at their base a double camber thus putting them back onto the face of the teeth 13B. Alternatively, the teeth 13A and 13B of the two small plates could be offset, in a less pronounced manner, in order to be on a common face after assembly, with a second step distance P2 between the successive teeth. It is noted that the value of this step is not relative to the fact that the comb has been executed in two halves which may be assembled and separated. The value of the step P2 depends on the size of the carriers 5. On each half 14A and 14B, teeth 13A and 13B are necessarily spaced at a step 2P2.

The detachable comb 14 of FIGS. 7 to 9 and the pick-up 8 of FIG. 5 are used in the following way:

The comb 14 is assembled and its teeth 13A and 13B are arranged on a carrier 5. The elements of identification 4 are picked up, two by two, in the switch cover 1 with the pick-up means 8', consisting of two arms 11A' and 11B'. The two elements are then introduced simultaneously into the first tubular section 6 of the two elements of identification 4 which are situated on two teeth next to the assembled combined comb 14. This procedure is repeated as often as necessary to compose and dispose, at the same time, on two carriers 5 the desired coded message, for example TX1 on the two teeth at the extreme left of FIG. 1.

Once a coded message of identification is composed in pairs on all the teeth of the comb 14, the two halves 14A and 14B of the combined comb are separated in order to obtain the two halves, as shown in FIG. 9, which carry, in the same order, identical coded messages due to the fact that these messages have been composed simultaneously. Half 14A locates the wire strands of one end of the electric cable, whereas the other half locates the strand of the other end of the same cable. The risk of error in the composition of the coded messages is eliminated which must be identical for both ends of the strands.

It is also noted that the device of the invention permits the preparation, in advance, of coded messages of identification on the combs 9 and 14, preferably on the detachable combs 14A and 14B, whereas previously they had to be composed at the point of connection of the strands, first for one and then for the other end.

Figure 10:
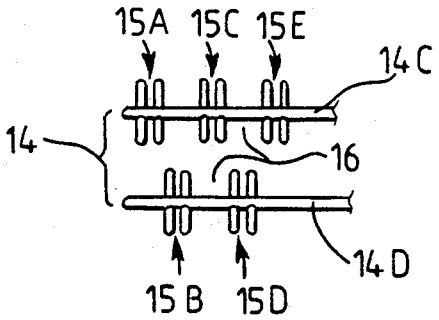
FIG. 10 illustrates a variation of the comb according to the invention.

FIG. 10 presents a diagrammatic view, on a smaller scale, of part of the two halves 14C and 14D of a comb 14 on which the teeth are arranged in pairs 15A to 15D at an interval distance 16 from two nearby teeth capable of receiving a pair of teeth from the other half so that, on the assembled comb, successive teeth, which are spaced at a step P2, belong in pairs and alternatively to half 14C and to half 14D. The comb of FIG. 10 is used with the pick-up means 8 with four arms 11A to 11D spaced at a second step distance P2 as per FIG. 4.

In this manner, four identical messages of identification can be composed simultaneously on the assembled comb of FIG. 10. After the separation of the two halves of the comb, the four messages are themselves separated into two identical pairs, for example, on the pair 15A and on the pair 15B. At each of the two distant ends of an electric cable, the wire strands and the electric terminals, corresponding to these strands, are easily located without the risk of error in the composition of the four messages. The terminals of the two switch cabinets, which are at equal distances, may also be located.

In accordance with the invention, the execution of the comb 9 in more than two toothed parts is possible, for example, in three parts or more which are separated by the appropriate thickness of parallel joint faces, whereby the teeth of the assembled comb belong, respectively, to different toothed parts. Preferably, the teeth 13, which are spaced at a step P2 on the assembled comb 9, respectively, belong to the toothed parts. Such a comb is used with a pick-up means 8, the number of arms 11 of the pick-up means is equal to the number of toothed parts of the comb.

The means of pick-up 8 may be improved in the following manner: in the example illustrated in FIG. 3 where there are two arms 11A and 11B at a step distance P2=P1, each end part 11A and 11B is followed, beyond the detent collar 12, by a long center part 17A, 17B, respectively, the width of which is substantially equal to the inner width of the first tubular section 6 of the carrier 5 and the length of which is substantially equal to the length of this first tubular section 6. The two arms 11A and 11B are separated by a slot 18, the length of which is identical to the width of the center parts 17A and 17B.

Following the pick-up means, once two elements of identification 4 are mounted by the arms 11A, 11B and on introducing them simultaneously into the two nearest carriers 5, these elements are pushed by means of the detent collar 12 to the desired depth by also engaging the long center parts 17A and 17B in these carriers 5. The slot 18 permits the separation of one or the other of the near edges of the two center parts and thus facilitates their respective entry to the inside of the carriers 5. In the example illustrated in FIG. 5, where the arms 11A' and 11B' are spaced at a step distance P2=P1, the long center parts 17A' and 17B' are separated by a recess or groove 18' where the groove is only an enlargement corresponding to the width of the slot 18.

It can be recognized on the Figures that there is a marker carrier 101, which is formed in a conventional manner by a tubular cover section 101*a*, furnished, along one of its elongations, with a likewise tubular housing 101*b*. Pointers 102, which are also tubular and form the marker, are placed in the housing 101*b*. The invention device is a band section 103 furnished at each one of its ends with an opening 104 covered by a crossing-over or by a catch bridge. The catch bridge is oriented in the longitudinal direction and forms passage eyelets for the fixing bonds 106 of the support to objects such as cables, bundles, etc. to be identified. The catch bridges form one single piece with the band which is of a flexible material, for example a plastic material, such that the introduction of the marker carrier 101 results in a crushing of the catch bridge when it passes over same. The catch bridge stands up straight again and rebounds thereafter and forms a limit stop which does not allow the escape of the support carrier. Said limit stop is reinforced by the presence of the bonds 106.

Figure 11:
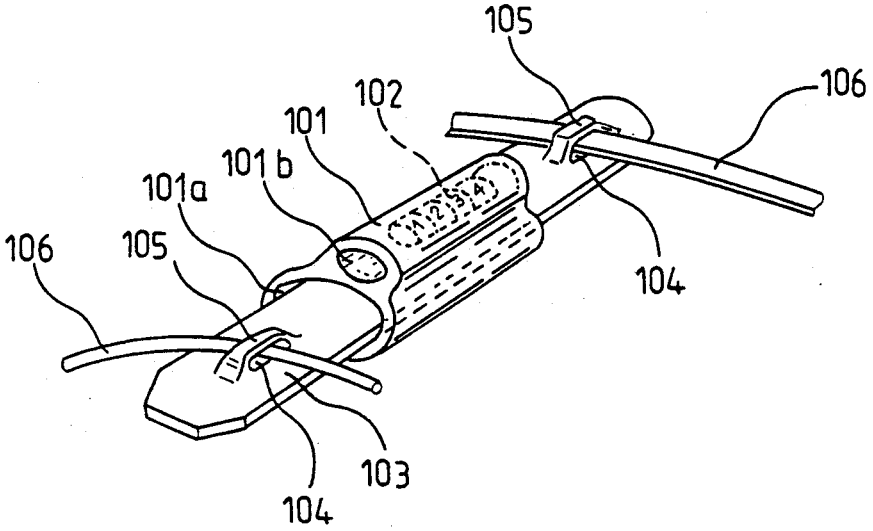
FIG. 11 is a perspective view of an embodiment of the invention.
Figure 12:
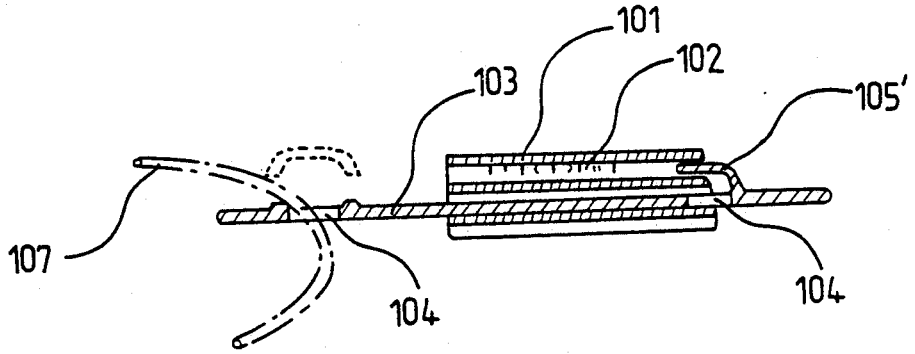
FIG. 12 is sectional view of the embodiment of FIG. 11, showing the different possibilities of use.

FIG. 12 includes the majority of the elements which are already described in connection with FIG. 11, with the same reference numerals. FIG. 12 illustrates that one can section a crossing-over 105, completely as shown to the left of the figure, in order to uncover the opening 104 and in order to allow a band 107 to pass through or, in part as shown to the right of the figure, where only the foot, turned toward the median section of the band section 103, has been sectioned. The therefrom resulting catch bridge 105' becomes a hook, where the end of the hook is introduced into the housing 101*b* and which forms a member for retaining the marker carrier on its support.

Figure 13:
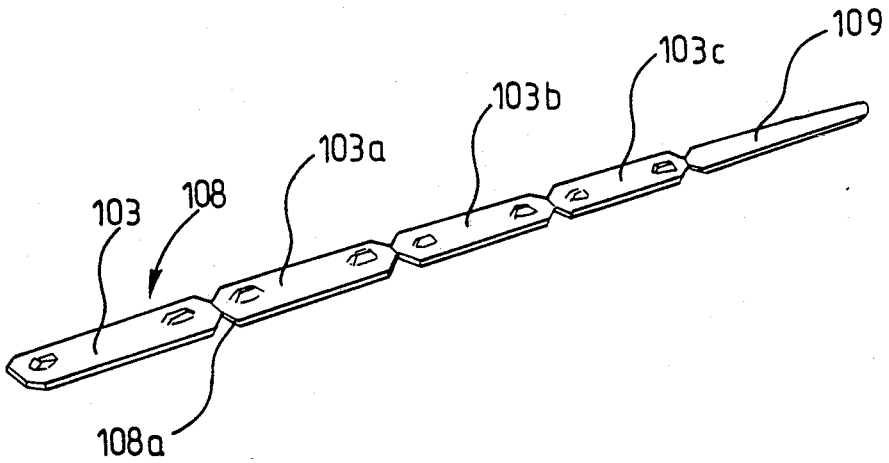
FIG. 13 is schematic representation of the supports for the markets according to the invention.

FIG. 13 finally shows that each section 103, 103*a*, 103*b* . . . derived by separation of a continuous band 108, which is furnished with weakened zones 108*a* and which allows an easy separation of each section, preferably without any tools. One of the ends of this band 108 carries a small tongue 109 forming a needle to facilitate the introduction of the marker carriers.

Figure 14:
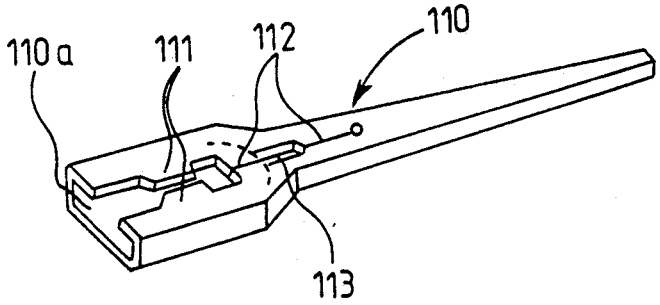
FIG. 14 illustrates a variation of the embodiment of FIG. 13.
Figure 15:
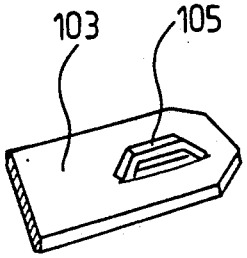
FIG. 15 is a perspective view of a part variation of FIG. 13.

FIG. 14 shows a variation of the embodiment of 13, wherein the tapered small tongue 110 for the entering of the marker carriers is separated from the sections 103 and can be joined to the free end of each of the sections 103 by means of a housing 110*a*, which housing 110*a* is provided to each tongue 110*a* at its non-tapered end. Preferably, this housing 110*a* is partially open on its outer face and is furnished with lugs 111 which can elastically ratch and lock in the interior of the crossing-over or of the catch bridge 105.

For this purpose, the upper partition wall of the housing 110*a*, which carries the lugs 111, is split at 112 and an opening 113 allows the entering of a screwdriver blade to spread the lugs 110 and to free the lugs 110 from their engagement under the catch bridge 105.

One notes that various embodiments are possible. Some embodiments have only one opening at one end and have a hook at the other end without opening. Other embodiments comprise only projections in place of the catch bridges for forming the limit stops to the marker carriers.

The invention is particularly useful in the field of accessories for electrical materials and that of marker means.

Figure 16:
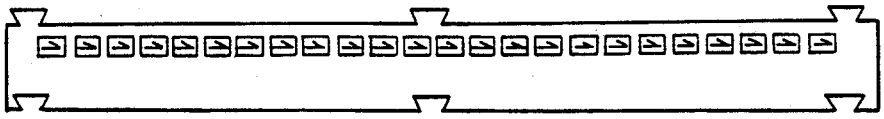
FIG. 16 illustrates an embodiment of a magazine frame.

An embodiment of a magazine frame is illustrated in FIG. 16.

Figure 17:
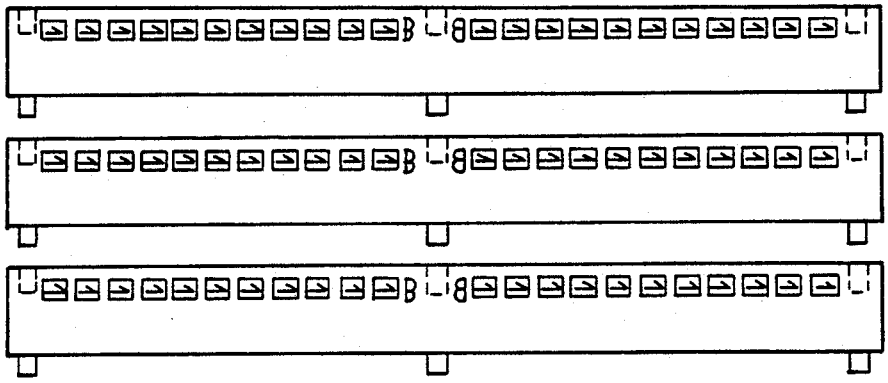
FIG. 17 illustrates a further embodiment of a magazine frame, showing 3 individual magazine frames.

A further embodiment of a magazine frame is illustrated in FIG. 17, illustrating 3 individual magazine frames which can be attached to each other.

Figure 18:
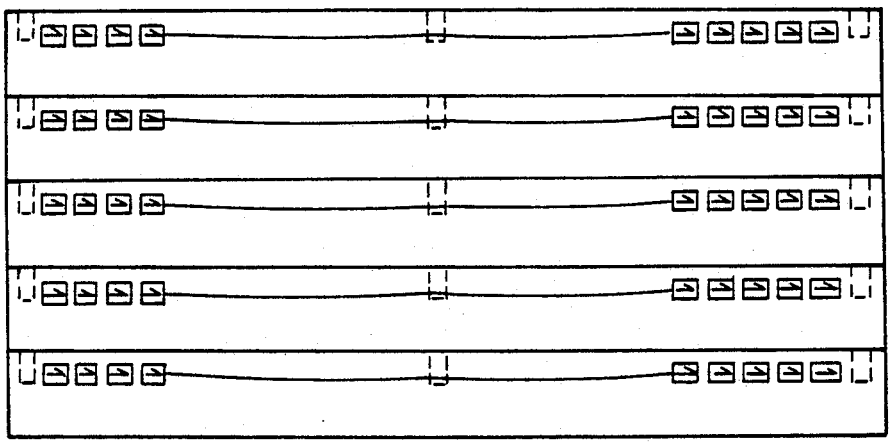
FIG. 18 shows the frames of FIG. 17 in an attached position.

The frames of FIG. 17 in an attached position are illustrated in FIG. 18.

Figure 19:
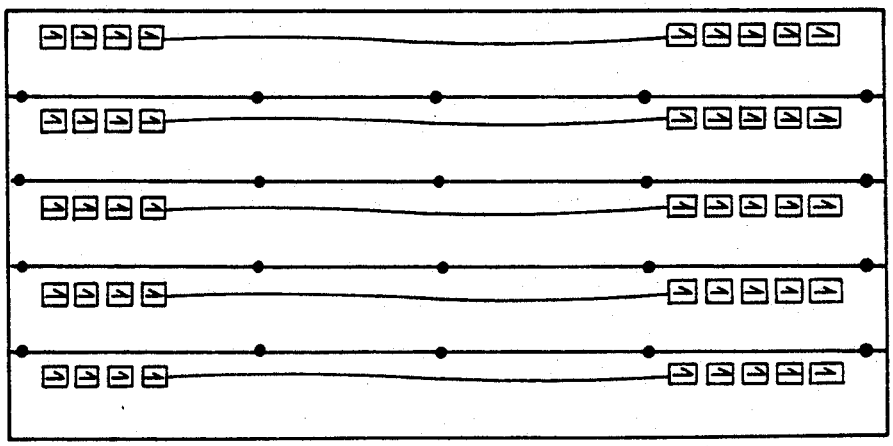
FIG. 19 illustrates a further view of an attachment of magazine frames to each other.

FIG. 19 shows a further view of an attachment of magazine frames to each other.

FIG. 20 shows a sequence of magazine frames. The section through the magazine frames of FIG. 20 are illustrated in FIG. 21.

FIG. 22 shows a side elevational view of an element of FIG. 20.

The cross section employed of a profile according to the present invention for supporting the markers, is illustrated in FIG. 22, in FIG. 24 and in FIG. 25. These profiles are distinguished in their way of being attached to the supports. In particular, the profile of FIG. 23 can be slid onto a support, the profile of FIG. 24 can be elastically mounted onto a support, and the profile of FIG. 25, again, is suitable for being slid onto a support.

FIG. 26 and FIG. 30 show a top view of a finger. The cross section of the finger at the level A of FIG. 26 is shown in FIG. 27 and the cross section of the finger of FIG. 30 is shown in FIG. 31.

The FIG. 28 illustrates the cross section at a wider collar of the embodiment of FIG. 26 and the FIG. 32 illustrates the cross section of a wider embodiment of the finger of FIG. 30.

FIG. 29 illustrates the placement of a profile onto a finger as illustrated in FIG. 26 and FIG. 33 indicates the placement of a tubular part onto the finger of FIG. 30.

In FIG. 34, there is illustrated a cross section of the embodiments according to FIG. 30 and/or FIG. 26.

Figures 35, 36, 37, 38, 39, 40, 41, 42, 43:
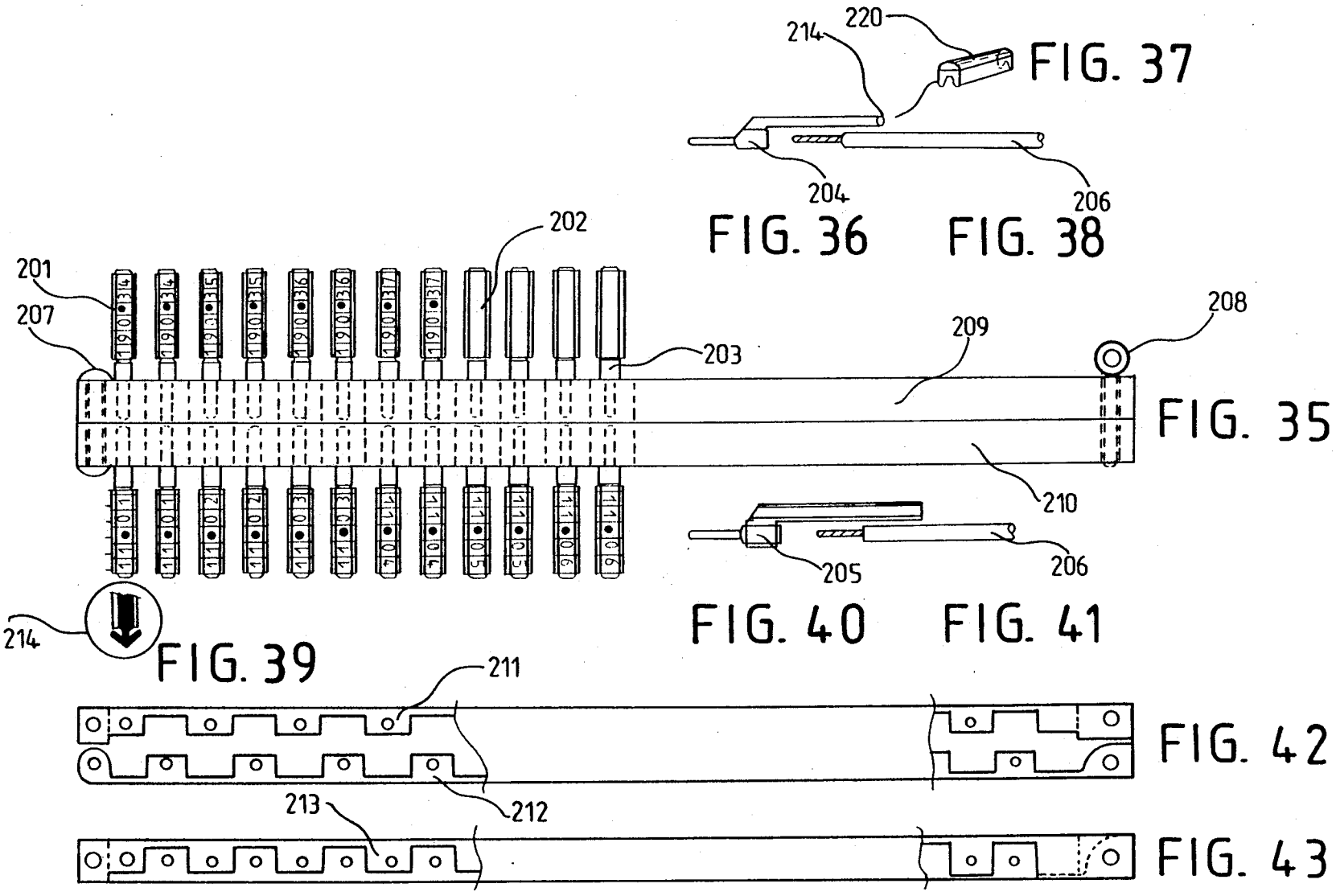
FIG. 35 illustrates a mounting plurality of indicating markers onto respective fingers.
FIG. 36 illustrates the placing of tubular elements onto the end of a finger.
FIG. 37 is a perspective view of a tubular element.
FIG. 38 illustrates the mounting of a magazine frame onto an element.
FIG. 39 illustrates the removal of a locking element from one of the fingers.
FIG. 40 is a view similar to embodiment of FIG. 36 with the attached marking elements.
FIG. 41 is a view of an embodiment similar to the embodiment of FIG. 38.
FIG. 42 illustrates the relative positioning of the fingers and of the marking elements of FIG. 35.
FIG. 43 illustrates the assembly of the elements shown separately in FIG. 42.

FIG. 35 illustrates a mounting plurality of indicating markers onto respective fingers. The two rows are maintained together by a fastening means illustrated at the 207 and 208. The narrow section of the fingers is illustrated at 202 and the collar section of the fingers is illustrated at 203 in FIG. 35. The fingers are attached to a magazine frame 209 or 210, respectively.

FIG. 39 illustrates the removal of a locking element from one of the fingers 202.

FIG. 36 illustrates the placing of tubular elements 220 and 214 onto the end of a finger. The mounting of a magazine frame 204 onto an element 206 is illustrated in FIG. 38.

FIG. 40 is a view similar to the embodiment of FIG. 36 with the attached marking elements and FIG. 41 is a view corresponding to that of FIG. 38 with the element 206.

FIG. 42 illustrates the relative positioning of the fingers and of the marking elements of FIG. 35 prior to the combination of the elements supporting them. The correspondance of the elements 211 and 212, relative to the fingers carrying the tubelets with the markers illustrated in FIG. 35, can be recognized.

FIG. 43 shows the assembly of the elements shown separately in FIG. 42. As shown in FIG. 43, this is essentially a cross section of the embodiment of FIG. 35 and, at the left and right end, the fastening element is schematically indicated.

Figure 44:
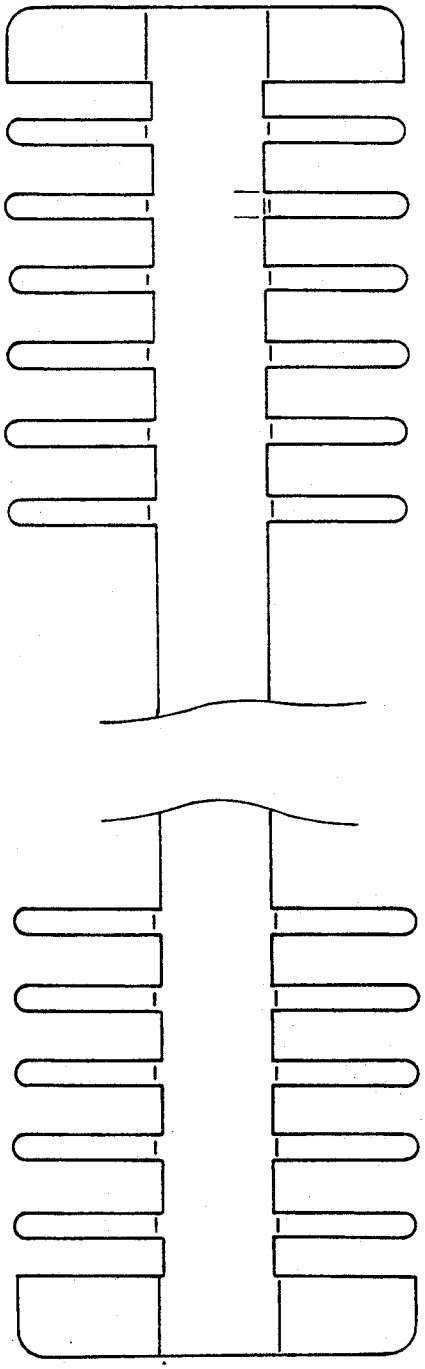
FIG. 44 illustrates a schematic diagram of a comb with the fingers.

FIG. 44 is a schematic diagram of a comb with the fingers. However, in this case, the comb has a flat base, and the fingers of the comb are positioned at an angle versus the plane defined by the base section. The angle of the comb can be from about 20° to 45° and is preferrably between about 25° and 30° versus the plane of the base.

The transparent section of the double tube illustrated in FIG. 17 is furnished so that it adapts over a wide range of a section of wires to be marked. This is obtained by the adding of a third cavity illustrated in FIG. 22. As set forth already, additional profile embodiments are illustrated in FIGS. 24 and 25.

The range of sections which can be employed for the cables for electrical controls, runs currently from about 0.8 mm to 2.5 mm and, in fact, in order to cover this range, there are three support models employed as illustrated in FIG. 22.

The improvements furnished to these supports illustrated in FIGS. 22, 24, and 25 have in a single support cover, the range of 0.5 to 3 mm. When combs are employed which are carrying these supports on the same comb, one recognizes that the markers which follow each other are furnished for different sections.

FIGS. 20 and 21 illustrate a magazine frame filled with existing elements according to FIG. 22 and which provide support for numbered sections at the interior of the magazine frame. The simple friction of the lateral arms is employed on the basis of these supports for attachment.

Figure 45:
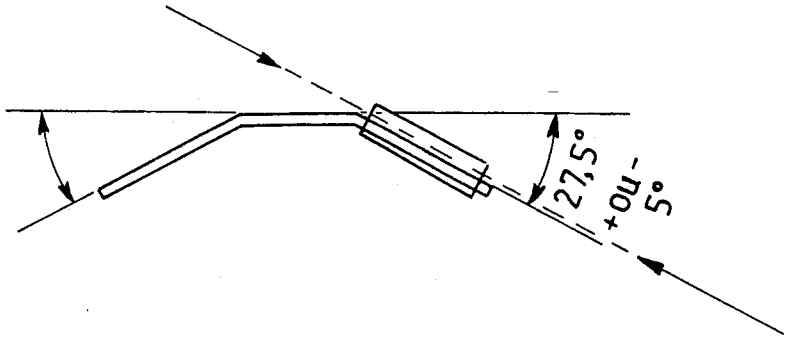
FIG. 45 illustrates a comb where the teeth are inclined relative to a horizontal plane of the base by about 27.5°.

FIG. 35 represents a demountable comb, as it is. However, the teeth or fingers of the comb of FIG. 35 are different than the ferrule. The details of the small tongues are illustrated in FIG. 40. The FIG. 44 illustrates a comb and a top plane view of a comb. FIG. 45 illustrates a comb where the teeth are inclined relative to a horizontal plane of the base by about 27.5°. This has the purpose of allowing the charging and furnishing of supports to a double tube with the desired goal. The profile of FIG. 45 is particularly attractive for the comb described and illustrated in FIG. 35. In this case the inclination can be obtained by inclined bore holes and tabs of holes, which are introduced in the ferrules along its length. The embodiment shown for the finger in FIGS. 31, 32, and 33, are particularly suitable where these fingers are elastic and such structures can be particularly easily maintained.

Figure 46:
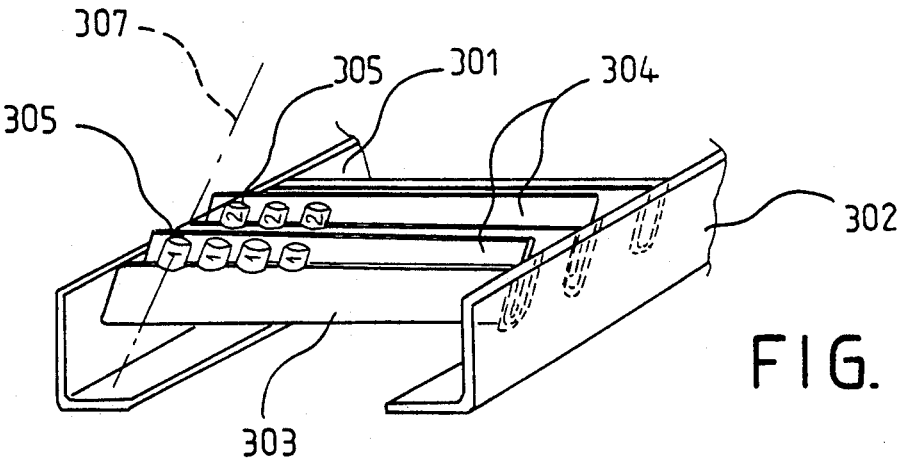
FIG. 46 is a perspective view of a storage frame according to a first embodiment.
Figure 47:
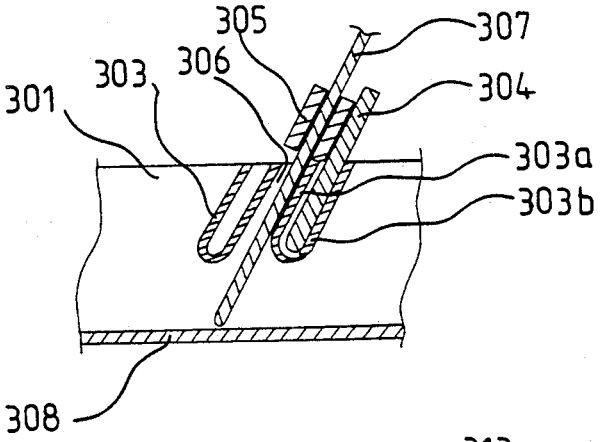
FIG. 47 is a sectional view of a detail of the storage frame of FIG. 46.

Referring to the figures and in particular to FIGS. 46 and 47, there is shown a storage frame according to the invention which comprises two longitudinal side partitions 301 and 302 braced by a plurality of inclined profiles 303. The braces form U-shaped troughs for receiving the platelets 304 onto which tubular points 305 are affixed by gluing. The gap between the branches 303*a*, 303*b* of the U smaller than the thickness of the platelet 304 equipped with the pointers 305 having an elongated direction along a line 307 such that the pointers protrude toward the outside of each trough.

A space 306 is provided between the compartments defined by the troughs 303, where the size of the space 306 is large enough such that the pointers of one partition do not contact the neighboring partition. This space allows the introduction of a gripper 307 which can be formed by a stem capable of being introduced into each one of the pointers. The depth of these space, which determines the penetration course of the gripper, is determined by the height of the partitions 301 and 302 and will always be larger by at least one time the axial length of a pointer in such a way as to cause the embedding of the pointer onto the gripper at a sufficient height level in order to avoid the untimely loosening of the pointer from the gripper.

In the case of FIG. 46, this depth is equal to several times the axial length of each pointer and the penetration of the gripper is limited by an end shoulder, not shown, which abuts against the pointer into which the gripper was introduced.

According to another embodiment, the troughs 303 are interconnected by the bottom of the U with a lower support plate 308. In this case, the height of the U is to be larger at this axial dimension of the pointer in such a way that the embedding be correctly performed before the end of the gripper comes to abut against the support plate.

It is also noted that the pointers are retained in the bottom by the front partition of each compartment 303 against the driving force which the gripper exerts onto the pointers. In fact, either this force remains lower to the gluing force and pointer is maintained in place, or this force is larger than the gluiding resistance and the pointer comes to abut against the upper edge of this front partition. The platelet 304 can larger than the depth of the compartment 303 and can rest at the bottom of the compartment 303, or the platelet 304 can be smaller and rest on the upper edge of the front branch by the pointers themselves.

Figure 48:
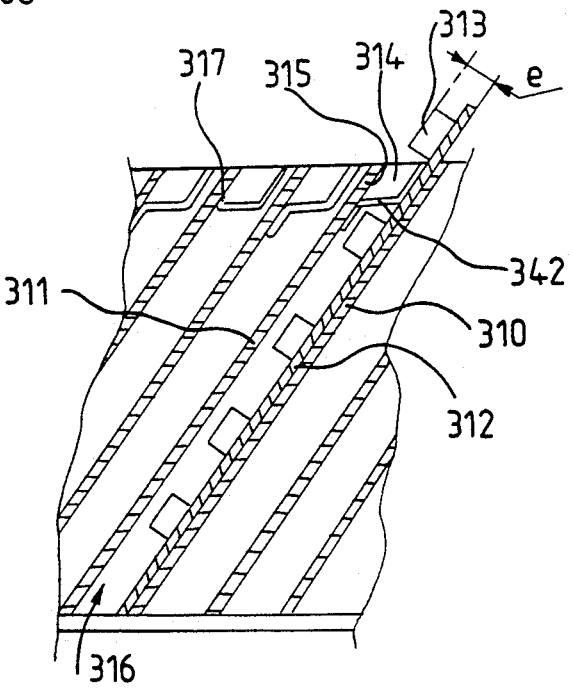
FIG. 48 is a schematic, sectional view of a storage frame according to a second embodiment.

The embodiment illustrated in FIG. 48 refers to a variation of the invention. Each of the compartments of the storage frame comprise a rear partition 310 and a front partition 311. Both the rear partition 310 and the front partition 311 are inclined and spaced apart from each other by a value which is higher than the thickness e of a plate 312 furnished with pointers 313. The plate 312 can comprise several rows of pointers 313 and has in an advantageous way a fracture line between each row of pointer allowing to lift out the bare support part.

The front wall 311 comprises an upper part 314 turned rearwardly toward the plate 312 between two rows of pointers. This rearwardly turned upper part 314 with an upper middle section 342 can be elastically deformed or can hinged at 317 and can be brought back by a spring device. The pointers 313 of the upper row are support on the upper edge of this part 314 which delimits at 315 the space between two compartments into which the gripper is entered. The wall 314*a*, forming a bridge across the partions 310 and 311, forms an inclined cam surface on which the end of the gripper slides, thereby forcing the loosening of the pointers.

One can realize that the placing of the plates 312 is performed by their introduction into the compartments through a lower opening 316 of the storage frame in order to force the passage of the first row of pointers 313 by lifting up of the part 314. The wall 310 can also comprise notching means which retain, at each extraction level of the plate 313, this plate 313 against its tendency to slide downwardly.

The invention can be applied in the field of accessories for electrical material.

Figure 50:
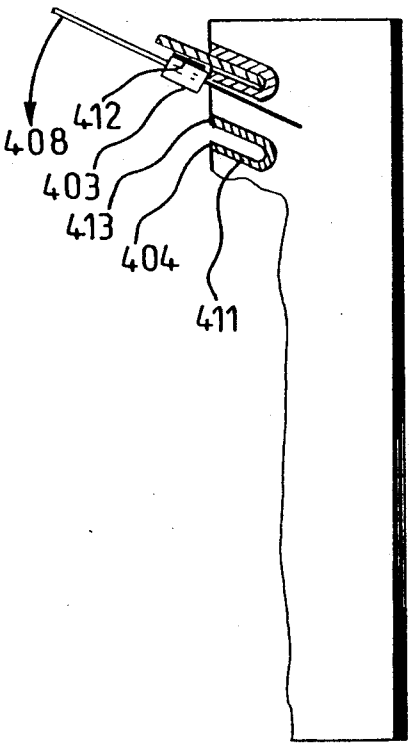
Figure 49:
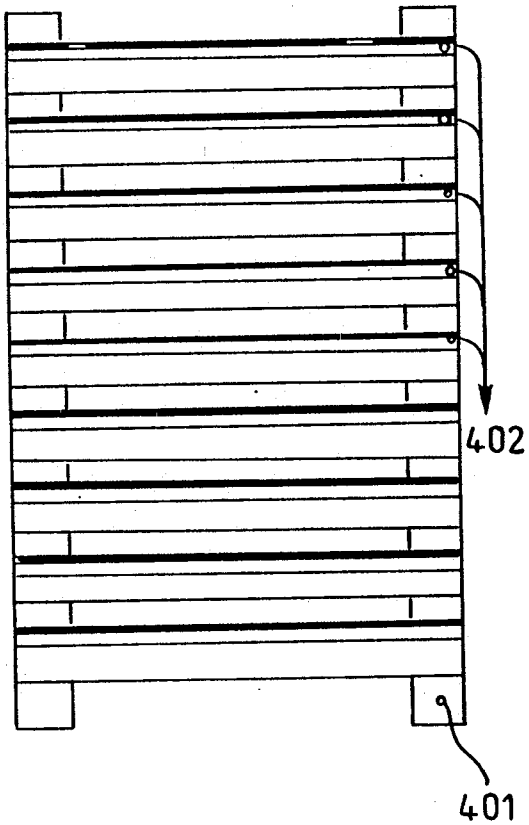

FIG. 49 illustrates an assembly of a plurality of magazine frames with partitions 401 and 402. FIG. 50 is a cross section of the embodiments of FIG. 49 illustrating the insertion of the elements 412 into the holes 411.

Figure 51:
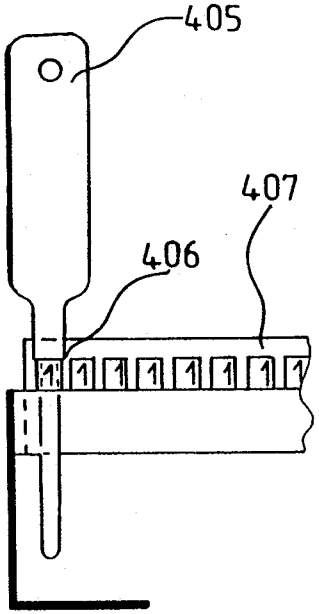

FIG. 51 is a plan view of positioning of element 406 into the magazine frame 407.

It will be understood that each of the elements described above, or two or more together, may also find a useful application in other types of pick-up and assembly device differing from the types described above.

While the invention has been illustrated and described as embodied in the context of a device for pick-up and assembly of identification elements of cables and electrical appliances, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. Support and fixation device supporting a marker carrier (101) comprising a tubular cover (101*a*) and a tubular housing (101*b*), wherein the tubular housing is furnished with a retaining section running substantially parallel to a lengthwise direction of the tube for receiving and retaining pointers;

a flat band section (103), made of a flexible material, furnished at each of its ends with an opening (104), the flat band section received in the tubular cover, with the tubular cover disposed between the openings, and wherein at least one of the openings is crossed over by a flexible, longitudinal crossing-over bridge (105).

2. The device according to claim 1, wherein the second opening (104) is also furnished with a flexible cross-over bridge (105).

3. The device according to claim 1, further comprising a retaining hook (105') for the tubular marker carrier (101).

4. The device according to claim 1, wherein the band section (103) is formed by a detachable section of the detachable section of the bond having ends, the detachable section of a band (108) where at least one of the ends of the band (108) is elongated by a small tapered tongue (109) for entering the market carried (101).

5. The device according to claim 1, wherein the band section (103) is formed as a detachable part of a band (108), the detachable part of the band having ends where one of the ends of the detachable part of the band is elongated by a small tapered tongue (110) and where one end (110*a*) of the paper tongue is embedded on a free end of the band section (103).

6. The device according to claim 5, wherein the small tongue (110) is furnished with means for retcheting and locking on the band section (103).

7. Support and fixation device supporting a marker carrier comprising a marker carrier formed as a tubular cover having a housing for a plurality of pointers and having a second opening receiving a band section;

a band section made of a flexible material, furnished at each of its ends with an opening;

a flexible, longitudinal crossing-over bridge crossing over one of the openings disposed at the ends of the band section and wherein the marker carrier is supported on the band section and disposed on the band section outside of an area of the cross-over bridge and near a center of the band section between said openings of the band section.

8. The device according to claim 7 further comprising a second flexible cross-over bridge furnished at a second one of the openings of the band section.

9. The device according to claim 7, further comprising a retaining hook for the tubular marker carrier.

10. The device according to claim 7 further comprising a second band section having a first end and having a second end and detachably attached with its first end to the band section.

11. The device according to claim 10 further comprising a small tapered tongue where at least one of the ends of the second band is elongated by a small tapered tongue for entering the marker carrier.

12. The device according to claim 7 further comprising a small tapered tongue elongating one end of a detachable part of a band forming the band section and wherein one end of the small tapered tongue is covering a free end of the band section.

13. The device according to claim 12 further comprising means on the small tongue for ratcheting and locking on the band section.

14. The device according to claim 12 wherein the one end of the small tapered tongue covering the free end of the band section is formed as a housing partially open on its outer face and furnished with lugs which can elastically ratchet and lock to the crossing-over bridge.

15. The device according to claim 14, wherein the housing comprises an upper partition wall carrying lugs and split and forming an opening for allowing the entering of a screwdriver blade to spread the lugs and to free the lugs from their engagement under the crossing-over bridge.

16. The device according to claim 7 wherein the cross-over bridge forms a hook and wherein an end of the hook is introduced into the housing thereby providing a member retaining the marker carrier.

* * * * *